US011626663B2

(12) United States Patent
Lee et al.

(10) Patent No.: US 11,626,663 B2
(45) Date of Patent: Apr. 11, 2023

(54) BAND CHANGER AND COMMUNICATION SYSTEM INCLUDING THE BAND CHANGER

(71) Applicant: Intellian Technologies, Inc., Pyeongtaek-si (KR)

(72) Inventors: Hyun Uk Lee, Goyang-si (KR); Seung Hyun Cha, Seongnam-si (KR)

(73) Assignee: Intellian Technologies, Inc., Pyeongtaek-si (KR)

( * ) Notice: Subject to any disclaimer, the term of this patent is extended or adjusted under 35 U.S.C. 154(b) by 667 days.

(21) Appl. No.: 16/590,129

(22) Filed: Oct. 1, 2019

(65) Prior Publication Data

US 2020/0243965 A1 Jul. 30, 2020

(30) Foreign Application Priority Data

Jan. 24, 2019 (KR) ..... 10-2019-0009063
Sep. 11, 2019 (KR) ..... 10-2019-0113064

(51) Int. Cl.

| | |
|---|---|
| ***H01Q 3/06*** | (2006.01) |
| ***H01Q 3/14*** | (2006.01) |
| ***H01Q 5/45*** | (2015.01) |
| ***H01Q 19/17*** | (2006.01) |

(52) U.S. Cl.
CPC ..... *H01Q 5/45* (2015.01); *H01Q 3/06* (2013.01); *H01Q 3/14* (2013.01); *H01Q 19/17* (2013.01)

(58) Field of Classification Search
CPC .. H01Q 3/06; H01Q 3/14; H01Q 5/45; H01Q 19/17
See application file for complete search history.

(56) References Cited

U.S. PATENT DOCUMENTS

| | | | | |
|---|---|---|---|---|
| 8,497,810 | B2 * | 7/2013 | Kits van Heyningen | H01Q 3/18 343/781 CA |
| 10,038,251 | B2 * | 7/2018 | Wong | H01Q 19/192 |
| 11,133,598 | B2 * | 9/2021 | Patel | H01Q 3/08 |
| 2005/0275855 | A1 * | 12/2005 | Mizes | H04N 1/00002 358/463 |
| 2010/0238082 | A1 * | 9/2010 | Kits van Heyningen | H01Q 15/0013 343/779 |
| 2011/0068988 | A1 * | 3/2011 | Monte | H01Q 3/18 343/781 CA |

(Continued)

FOREIGN PATENT DOCUMENTS

| | | |
|---|---|---|
| EP | 2312693 A2 | 4/2011 |
| JP | H 05-091017 U | 12/1993 |

(Continued)

OTHER PUBLICATIONS

Korean Intellectual Property Office, Office Action, Korean Patent Application No. 10-2019-0113064, dated Jul. 14, 2020, 14 pages.

(Continued)

*Primary Examiner* — Ab Salam Alkassim, Jr.
*Assistant Examiner* — Anh N Ho
(74) *Attorney, Agent, or Firm* — Mintz Levin Cohn Ferris Glovsky and Popeo, P.C.

(57) ABSTRACT

A band changer includes a rotor having a rotation axis, and a plurality of transceivers disposed separately from the rotation axis and provided in the rotor along a circumferential direction of the rotor, and configured to transmit and receive waves respectively having different frequency bands.

24 Claims, 13 Drawing Sheets

(56) References Cited

U.S. PATENT DOCUMENTS

| | | | | |
|---|---|---|---|---|
| 2016/0141758 | A1* | 5/2016 | Eom | H01Q 1/12 343/757 |
| 2016/0298536 | A1* | 10/2016 | Lu | F02B 53/10 |
| 2016/0344107 | A1* | 11/2016 | Wong | H01Q 5/45 |
| 2016/0363738 | A1* | 12/2016 | Ito | G02B 21/248 |
| 2020/0052411 | A1* | 2/2020 | Noh | H01Q 3/20 |

FOREIGN PATENT DOCUMENTS

| | | | | |
|---|---|---|---|---|
| JP | 2010-136258 | A | 6/2010 | |
| KR | 20010036922 | A | 5/2001 | |
| KR | 10-2003-0085358 | A | 11/2003 | |
| KR | 20030085358 | A * | 11/2003 | |
| KR | 10-2012-0103104 | A | 9/2012 | |
| KR | 10-1477199 | B1 | 12/2014 | |
| KR | 10-1757681 | B1 | 7/2017 | |
| WO | WO-2017143500 | A1 * | 8/2017 | G01D 5/145 |

OTHER PUBLICATIONS

PCT International Search Report and Written Opinion, PCT Application No. PCT/KR2019/012807, dated Jan. 13, 2020, 14 pages.

* cited by examiner

BAND CHANGER AND COMMUNICATION SYSTEM INCLUDING THE BAND CHANGER

CROSS-REFERENCE TO RELATED APPLICATION(S)

This application claims the priority benefit of Republic of Korea Patent Application No. 10-2019-0009063 filed on Jan. 24, 2019 and Republic of Korea Patent Application No. 10-2019-0113064 filed on Sep. 11, 2019, both of which are incorporated herein by reference for all purposes.

BACKGROUND

1. Field

One or more example embodiments relate to a band changer and a communication system including the band changer.

2. Description of Related Art

An antenna, one of components for a communication system, refers to a device configured to transmit and receive radio waves of a set band. A plurality of antennas has been required to transmit and receive a plurality of waves having different bands. However, using such multiple antennas may be ineffective in terms of space use and costs, and not facilitate maintenance or repair. Thus, a single antenna including a plurality of transceivers having different bands is under development. For example, Korean Patent Registration No. 10-1757681 entitled "Satellite Communication Antenna Capable of Receiving Multiband Signal" discloses an antenna configured to transmit and receive signals of different bands, as an orientation of a sub-reflector of the antenna is adjusted while a plurality of feed horns is being installed fixed in a main reflector of the antenna.

SUMMARY

According to an example embodiment, there is provided a band changer including a rotor having a rotation axis, and a plurality of transceivers disposed separately from the rotation axis and provided in the rotor along a circumferential direction of the rotor, and configured to transmit and receive waves respectively having different bands. The transceivers used herein may indicate transmitters and receivers.

The rotor may be configured to rotate on the rotation axis such that a transceiver configured to transmit and receive a wave of a target band is located at a communication position by which a wave path is defined.

The rotor may be configured to rotate both in a first direction and a second direction which is opposite to the first direction.

The rotor may be configured to rotate only in the first direction.

A distance between the rotation axis and a first axis of a first transceiver among the transceivers may be equal to a distance between the rotation axis and a second axis of a second transceiver among the transceivers.

The rotation axis, the first axis, and the second axis may be parallel to one another.

The transceivers may be connected directly to one another.

According to another example embodiment, there is provided a communication system including a band changer including a main reflector, a sub-reflector, a rotor having a rotation axis, and a plurality of transceivers disposed separately from the rotation axis, provided in the rotor along a circumferential direction of the rotor, and configured to transmit and receive waves respectively having different bands. The rotor may be configured to rotate on the rotation axis such that a wave path leading to the main reflector, the sub-reflector, and one of the transceivers is formed.

The rotor may be rotatably provided in the main reflector to rotate with respect to the main reflector.

The rotor may be provided in an edge area of the main reflector.

The sub-reflector may include a sub-reflection plate disposed to face the edge area of the main reflector, and a supporting arm fixed to the main reflector and extending from the main reflector, and configured to support the sub-reflection plate.

The band changer may further include a stator provided in the main reflector and configured to support a rotation of the rotor.

The transceivers may be disposed to pass through front and rear sides of the rotor along the rotation axis of the rotor.

According to still another example embodiment, there is provided a communication system including a band changer including a rotor having a rotation axis, and a plurality of transceivers disposed separately from the rotation axis, provided in the rotor along a circumferential direction of the rotor, and configured to transmit and receive waves respectively having different bands, a controller configured to generate a control signal that determines a rotation angle of the rotor in response to selection of a frequency band by a user such that a transceiver configured to transmit and receive a wave of a target band is located at a communication position by which a wave path is defined on a circumference of the rotor, and a driver configured to operate the rotor to allow the rotor to rotate based on the control signal.

The controller may be configured to generate a first control signal in response to selection of a first frequency band by the user to rotate, by a first angle, a first transceiver configured to transmit and receive a wave of the first frequency band, and generate a second control signal in response to selection of a second frequency band different from the first frequency band by the user to rotate, by a second angle different from the first angle, a second transceiver configured to transmit and receive a wave of the second frequency band different from the first frequency band.

The communication system may further include a sensor configured to sense a rotation angle of the rotor with respect to the rotation axis.

The band changer may further include a stopper configured to define a reference position that restricts a rotation of the rotor.

The controller may be configured to generate a reference control signal to control a rotation of the rotor such that the first transceiver is located at the reference position restricting the rotation of the rotor.

The controller may be configured to check whether the first transceiver is located at the reference position when the rotor operates.

The controller may be configured to check whether a band of a wave transmitted and received by the transceiver located at the communication position after the rotor rotates by the determined rotation angle corresponds to the target band.

According to yet another example embodiment, there is provided a method of controlling a band changer including a plurality of transceivers configured to transmit and receive waves respectively having different bands, the method including receiving an input on selection of a band from a user, generating a control signal based on the received input, and disposing, based on the control signal, a transceiver configured to transmit and receive a wave of the frequency band selected by the user to be at a communication position by which a wave path is defined.

The disposing may include moving, by a first distance, a first transceiver configured to transmit and receive a wave of a first frequency band in response to selection of the first frequency band by the user to define a first wave path, and disposing the first transceiver at the communication position.

The disposing may further include moving, by a second distance different from the first distance, a second transceiver configured to transmit and receive a wave of a second frequency band in response to selection of the second frequency band different from the first frequency band by the user to define a second wave path, and disposing the second transceiver at the communication position.

According to further example embodiment, there is provided a non-transitory computer-readable storage medium storing instructions that, when executed by a processor, cause the processor to perform the method.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the present disclosure will become apparent and more readily appreciated from the following description of example embodiments, taken in conjunction with the accompanying drawings of which.

DETAILED DESCRIPTION

Figure 1:
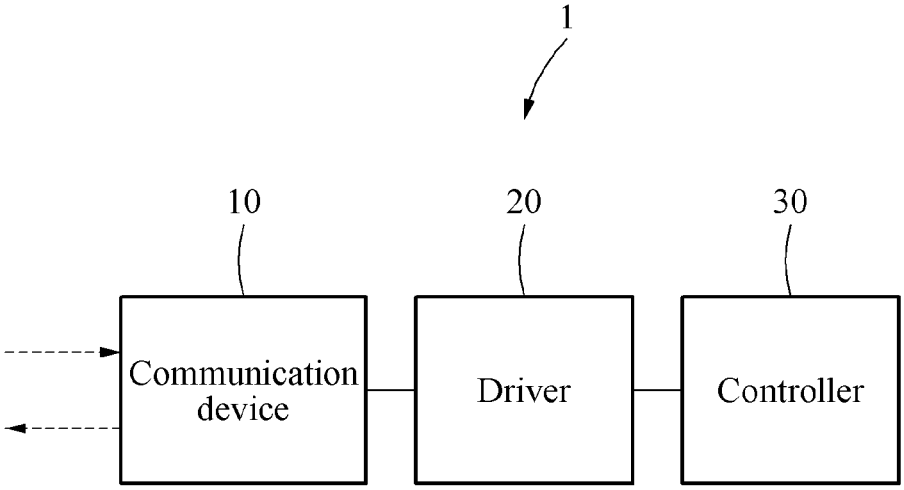
FIG. 1 is a diagram illustrating a communication system according to an example embodiment.
Figure 2:
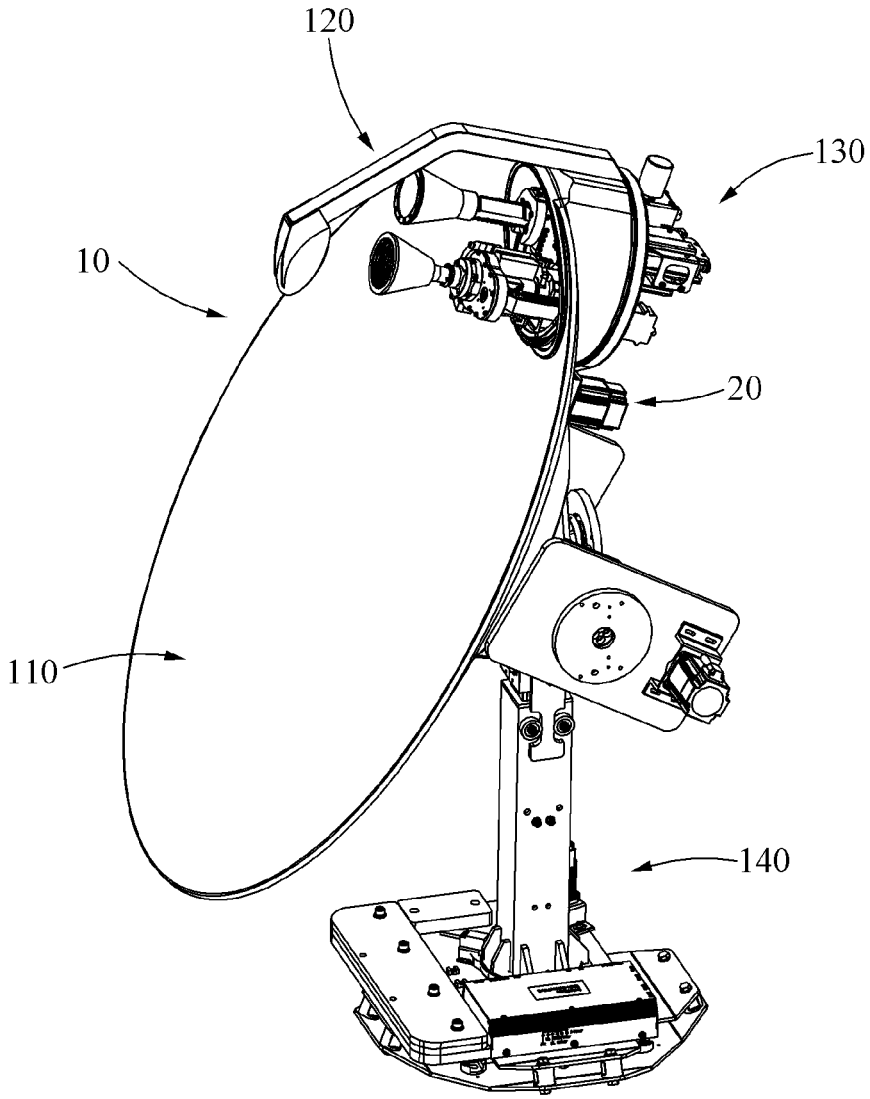
FIG. 2 is a perspective view of a portion of a communication system according to an example embodiment.
Figure 3:
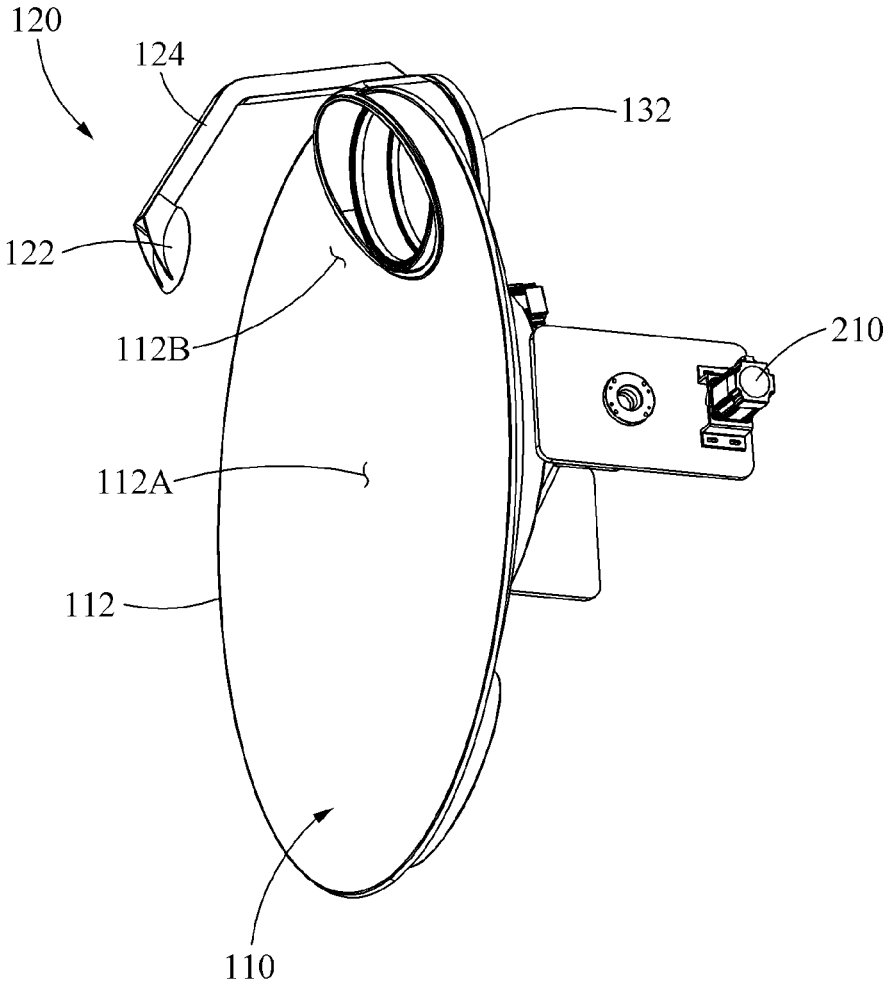
FIG. 3 is a perspective view of a communication system including a main reflector and a sub-reflector according to an example embodiment.
Figure 4:
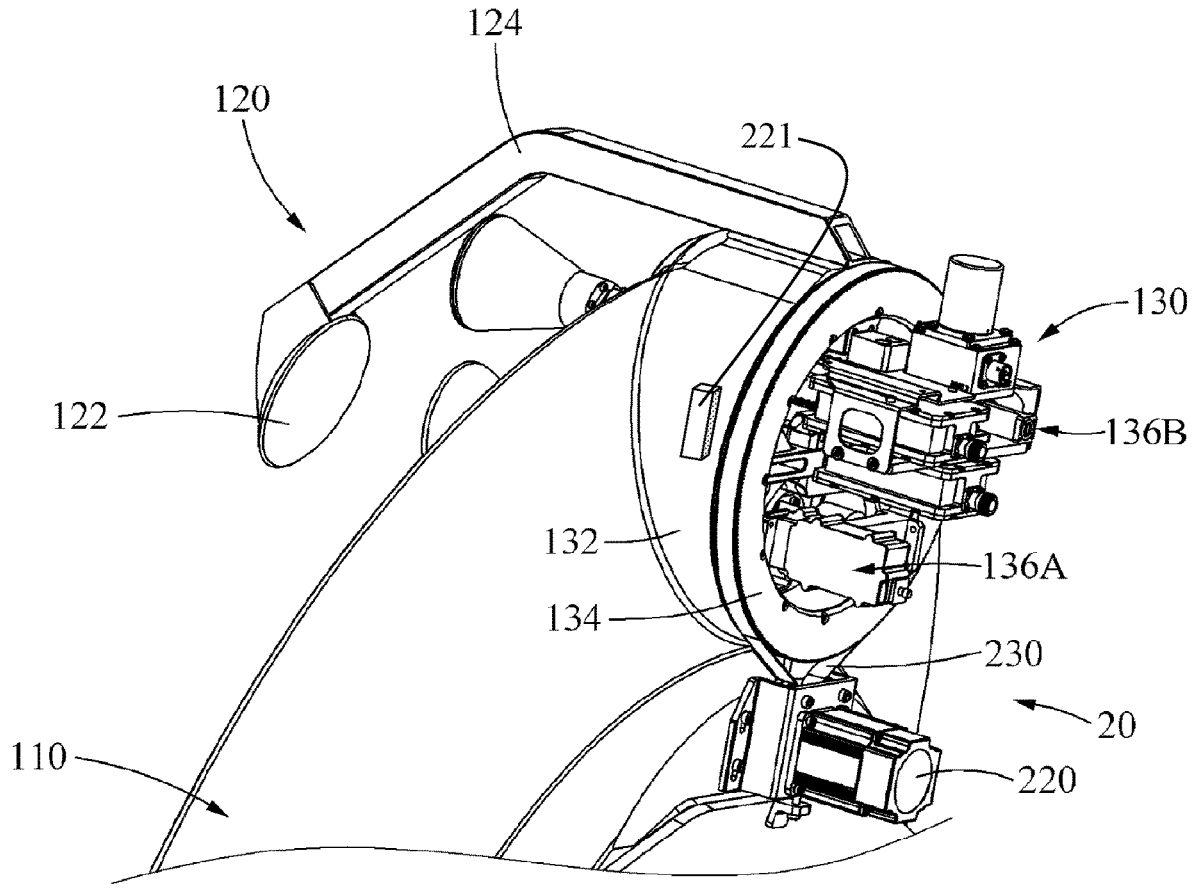
FIG. 4 is a perspective view of a rear portion of a communication system according to an example embodiment.
Figure 5:
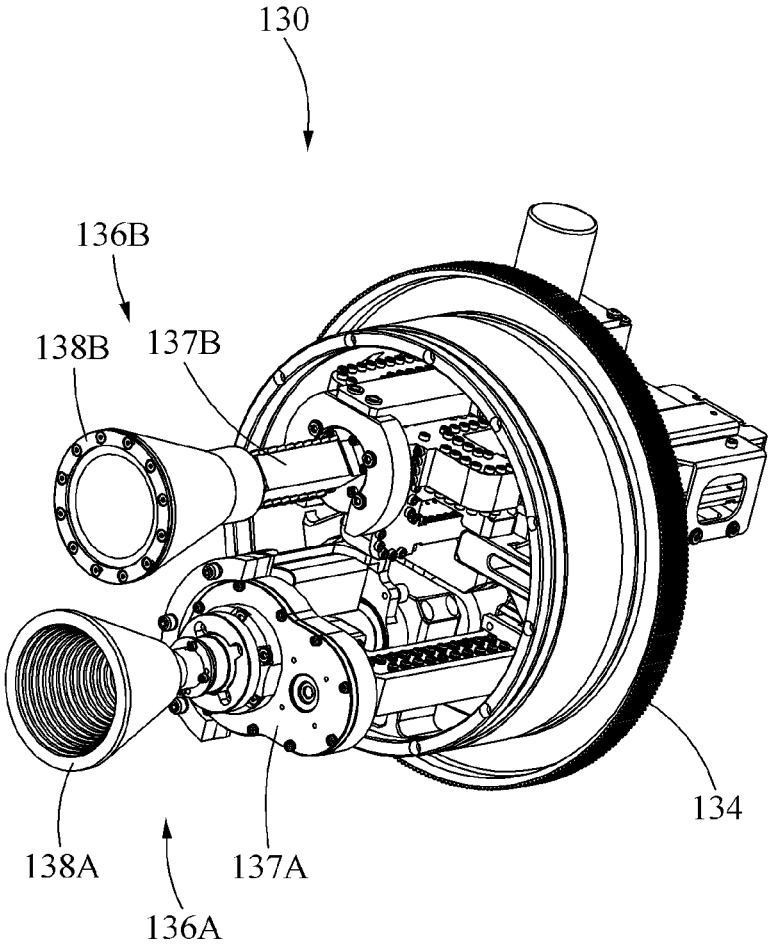
FIG. 5 is a perspective view of a band changer according to an example embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

The terminology used herein is for the purpose of describing particular embodiments only and is not intended to be limiting. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, operations, elements, and/or components, but do not preclude the presence or addition of one or more other features, integers, operations, elements, components, and/or groups thereof.

Terms such as first, second, A, B, (a), (b), and the like may be used herein to describe components. Each of these terminologies is not used to define an essence, order, or sequence of a corresponding component but used merely to distinguish the corresponding component from other component(s). For example, a first component may be referred to as a second component, and similarly the second component may also be referred to as the first component.

It should be noted that if it is described in the specification that one component is "connected," "coupled," or "joined" to another component, a third component may be "connected," "coupled," and "joined" between the first and second components, although the first component may be directly connected, coupled or joined to the second component. In addition, it should be noted that if it is described in the specification that one component is "directly connected" or "directly joined" to another component, a third component may not be present therebetween. Likewise, expressions, for example, "between" and "immediately between" and "adjacent to" and "immediately adjacent to" may also be construed as described in the foregoing.

Unless otherwise defined, all terms, including technical and scientific terms, used herein have the same meaning as commonly understood by one of ordinary skill in the art to which this disclosure pertains based on an understanding of the present disclosure. Terms, such as those defined in commonly used dictionaries, are to be interpreted as having a meaning that is consistent with their meaning in the context of the relevant art and the present disclosure, and are not to be interpreted in an idealized or overly formal sense unless expressly so defined herein.

Hereinafter, some example embodiments will be described in detail with reference to the accompanying drawings. Regarding the reference numerals assigned to the elements in the drawings, it should be noted that the same elements will be designated by the same reference numerals, wherever possible, even though they are shown in different drawings.

Referring to FIGS. 1 through 8, a communication system 1 according to an example embodiment is configured to receive a wave of a target frequency band from an outside, or transmit a wave of a target frequency band to an outside. A wave used herein may indicate a radio wave, or an electromagnetic wave.

The communication system 1 includes a communication device 10, a driver 20, and a controller 30.

The communication device 10 is configured to communicate with a target object. The target object may include, for example, a satellite that travels along a set orbit in a field of view (FoV) while transmitting and receiving waves. The communication device 10 may be provided in a ship or vessel, for example.

The communication device 10 includes a main reflector 110, a sub-reflector 120, a band changer 130, and a pedestal 140.

The main reflector 110 is configured to track a target object that travels in an FoV. The main reflector 110 includes a main reflection plate 112 configured to reflect a wave. The main reflection plate 112 is disposed in a direction facing the target object. The main reflection plate 112 may have a cross-sectional profile in a roughly parabolic form, for example. The main reflection plate 112 includes a center area 112A and an edge area 112B.

The sub-reflector 120 includes a sub-reflection plate 122 and a supporting arm 124.

The sub-reflection plate 122 is configured to reflect a wave reflected from the main reflection plate 112 to the band changer 130, or reflect a wave from the band changer 130 to the main reflection plate 112. The sub-reflection plate 122 is disposed in a direction facing the main reflection plate 112, in a direction facing the band changer 130, or in a direction facing a location therebetween. The sub-reflection plate 122 may have a cross-sectional profile in a roughly parabolic form, for example. A size of the sub-reflection plate 122 may be smaller than a size of the main reflection plate 112.

The supporting arm 124 is configured to support the sub-reflection plate 122. One end of the supporting arm 124 is fixed to an edge of the main reflection plate 112, and another end of the supporting arm 124 is fixed to the sub-reflection plate 122. In addition, the supporting arm 124 extends from the main reflection plate 112 and then bent or curved towards a center of the main reflection plate 112 based on a direction of sub-reflection plate 122.

The band changer 130 is configured to select one wave from a plurality of waves to transmit and receive a wave of a target band. The band changer 130 includes a stator 132, a rotor 134, a first transceiver 136A, and a second transceiver 136B.

The stator 132 is configured to support the rotor 134 such that the rotor 134 rotates with respect to the stator 132. The stator 132 is provided in the edge area 112B of the main reflection plate 112. That is, the band changer 130 is provided in the main reflector 110. Such structure may be simpler in design, and have relatively higher levels of dimensional stability and structural rigidity, compared to a structure where the band changer 130 is provided in the sub-reflector 120. In addition, it is possible to replace only the band changer 130, while the main reflector 110 and the sub-reflector 120 are being used.

The rotor 134 is rotatably provided in the stator 132 such that the rotor 134 rotates with respect to the stator 132. The rotor 134 has a rotation axis X. The rotor 134 is configured to rotate on the rotation axis X. The rotor 134 may desirably have one-dimensional rotational degree of freedom (DoF)

The rotor 134 has a plurality of rotational positions. The rotational positions may indicate rotation angles of the rotor 134 with respect to a reference at which the rotor 134 starts rotating. The rotation angles may include, for example, 30 degrees (°), 60°, 90°, 120°, and 180°. The rotational positions may correspond to or be associated with a frequency band of a wave to be transmitted or received by a selected transceiver to define a wave path (WP) between the transceiver, the sub-reflection plate 122, and the main reflection plate 112.

The rotor 134 is configured to rotate both in a first direction and in a second direction opposite to the first direction. Alternatively, the rotor 134 is configured to rotate only in the first direction. The first direction and the second direction may be one of a clockwise direction and a counterclockwise direction, respectively, with respect to the rotation axis X.

The first transceiver 136A and the second transceiver 136B are configured to transmit and receive waves respectively having different frequency bands. A band, or a frequency band, of a wave to be transmitted and received by the first transceiver 136A and the second transceiver 136B may include, for example, an L band, an S band, a C band, an X band, a Ku band, a K band, a Ka band, a Q band, a U band, a V band, an E band, a W band, an F band, a D band, and the like. A shape and a size of the first transceiver 136A and the second transceiver 136B may depend on a characteristic of a band of a wave to be transmitted and received by the first transceiver 136A and the second transceiver 136B.

Figure 9:
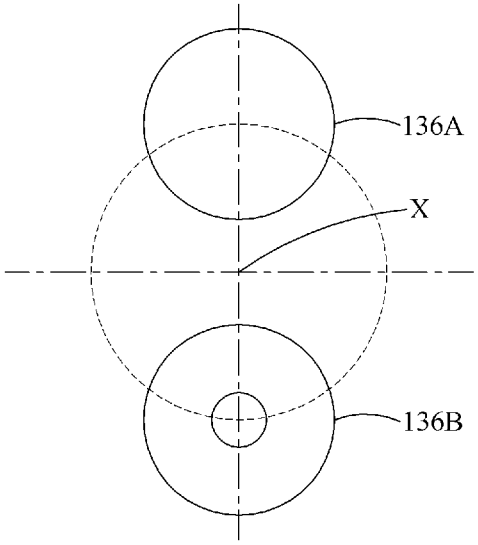
FIG. 9 is a conceptual diagram illustrating a band changer according to an example embodiment.

As depicted in FIG. 9 the first transceiver 136A and the second transceiver 136B are disposed separately from the rotation axis X, and provided in the rotor 134 along a circumferential direction of the rotor 134. When the rotor 134 rotates on the rotation axis X, the first transceiver 136A and the second transceiver 136B also rotate on the rotation axis X along with the rotor 134. How the first transceiver 136A and the second transceiver 136B are arranged in the rotor 134 may be affected by a size of the rotor 134. Thus, since the rotor 134 is relatively small, the first transceiver 136A and the second transceiver 136B may form a relatively small rotation area. Thus, the band changer 130 may have a reduced rotational moment of inertia.'

The first transceiver 136A and the second transceiver 136B have a first axis A1 in a longitudinal direction of the first transceiver 136A and a second axis A2 in a longitudinal direction of the second transceiver 136B, respectively. The first axis A1 and the second axis A2 are parallel to the rotation axis X. In addition, a distance between the rotation axis X and the first axis A1 is practically the same as a distance between the rotation axis X and the second axis A2. Through such structure, it is possible to achieve a relatively high level of positional precision of the plurality of transceivers including, for example, the first transceiver 136A and the second transceiver 136B, while the band changer 130 is performing radio communication with an external target object.

The first transceiver 136A and the second transceiver 136B are directly connected to each other. The first transceiver 136A and the second transceiver 136B rotate, as a single rigid body, on the rotation axis X along with the rotor 134 while the rotor 134 is rotating on the rotation axis X. Such structure may improve structural rigidity of the band changer 130, and reduce a rotational moment of inertia of the band changer 130. Thus, a driving torque required to drive or operate the band changer 130 may be reduced accordingly.

The first transceiver 136A includes a first body 137A extending from the rotor 134 by passing through front and rear sides of the rotor 134, and a first feed horn 138A provided at an end of the first body 137A and configured to transmit and receive a wave of a first band. The second transceiver 136B includes a second body 137B extending from the rotor 134 by passing through front and rear sides of the rotor 134 and a second feed horn 138B provided at an end of the second body 137B and configured to transmit and receive a wave of a second band different from the first band. A difference in terms of size and shape between the first body 137A and the second body 137B may depend on a characteristic of a wave to be transmitted and received.

The pedestal 140 is configured to support the main reflector 110. The pedestal 140 includes, for example, a base and a shaft extending from the base. The base may be provided in a target object, for example, a ship. The shaft is configured to rotate with respect to the base. The main reflector 110 is provided to rotate on the shaft. The main reflector 110 rotates on an elevation axis passing a side of the shaft.

The driver 20 is configured to supply power to the communication device 10 to operate the communication device 10. The driver 20 includes a first actuator 210 configured to supply power to the main reflector 110 such that the main reflector 110 rotates on the elevation axis, a second actuator 220 configured to supply power to the band changer 130 such that the band changer 130 transmits and receives a wave of a target band, and a belt 230 connected to the second actuator 220 and the band changer 130 and configured to transfer power of the second actuator 220 to the band changer 130. The first actuator 210 and the second actuator 220 are provided in the main reflector 110. In addition, the driver 20 may further include one or more additional actuators such that the main reflector 110 rotates on one or more other axes, instead of the elevation axis.

The controller 30 is configured to generate at least one control signal to control an operation of the band changer 130 such that the driver 20 allows the rotor 134 to rotate on the rotation axis X and the band changer 130 transmits and receives a wave of a target band. For a detailed description of how the controller 30 controls an operation of the band changer 130, reference may be made to the foregoing description of a structure of the band changer 130 and a description of an operation of the band changer 130 to be provided hereinafter. In addition, how the controller 30 controls the operation will be described in detail with reference to FIGS. 14 and 15.

Figure 6:
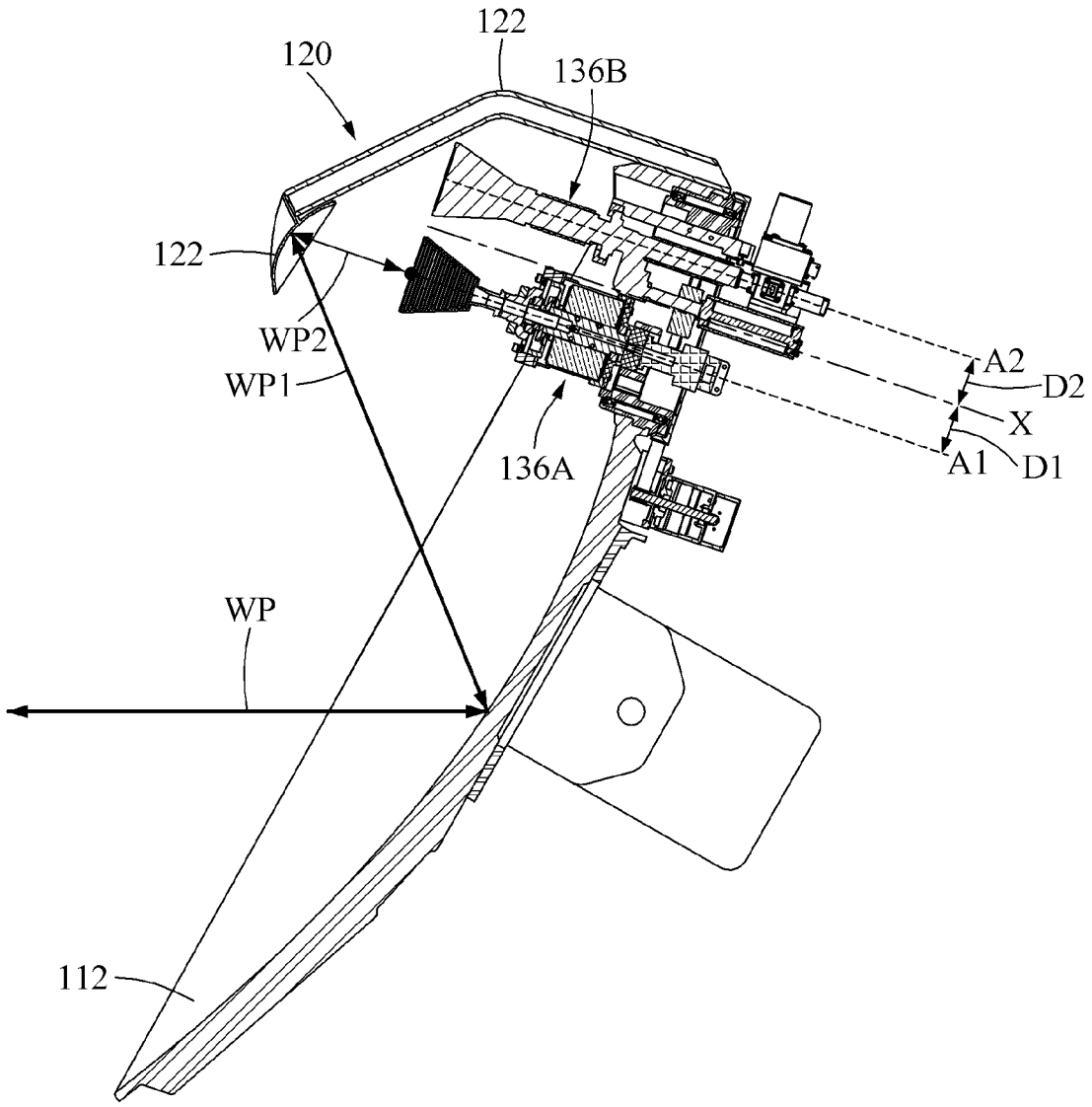
FIG. 6 is a cross-sectional view of a communication system according to an example embodiment.
Figure 7:
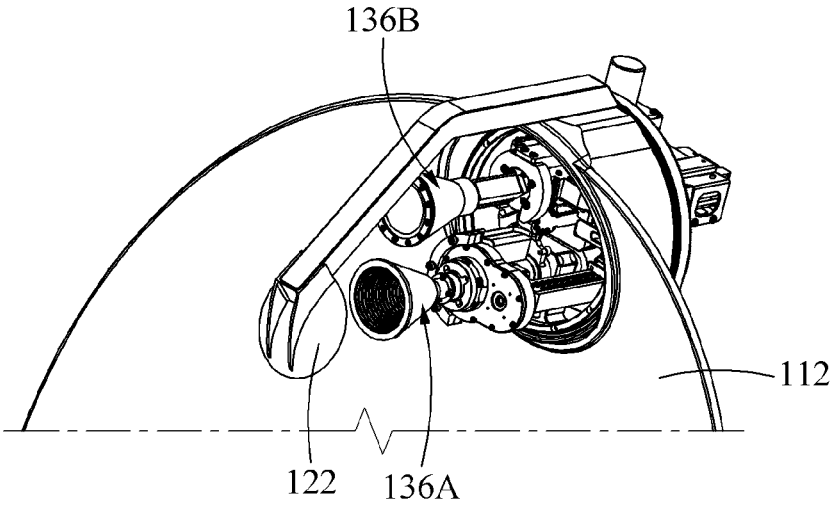
FIG. 7 is a diagram illustrating a first state of a communication system according to an example embodiment.
Figure 8:
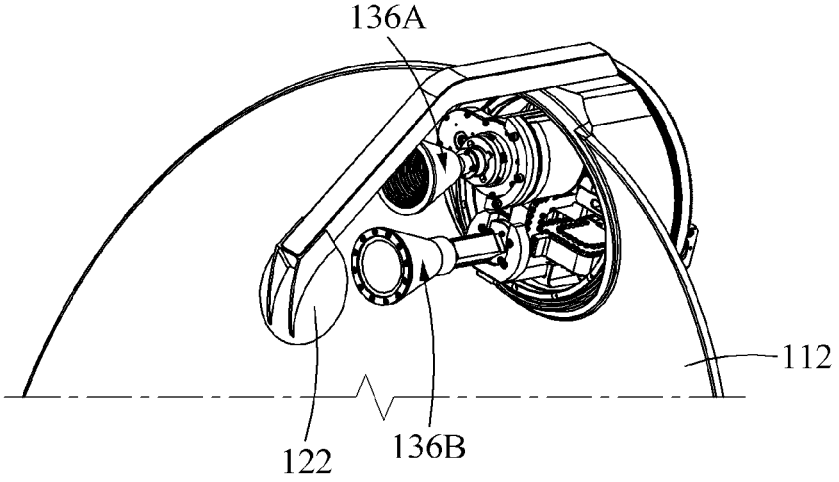
FIG. 8 is a diagram illustrating a second state of a communication system according to an example embodiment.

Referring to FIGS. 6, 7, and 8, when the rotor 134 (refer to FIG. 4) rotates by a first angle, a state of the communication system 1 in which a wave path WP between an external source and the main reflection plate 112, a wave path WP1 between the main reflection plate 112 and the sub-reflection plate 122, and a wave path WP2 between the sub-reflection plate 122 and the first transceiver 136A are defined may be verified. In such state, communication of a wave of a first band may be performed between the external source and the first transceiver 136A.

Referring to FIGS. 6 and 8, when the rotor 134 (refer to FIG. 4) rotates by a second angle, the wave path WP between the external source and the main reflection plate 112 and the wave path WP1 between the main reflection plate 112 and the sub-reflection plate 122 may be maintained the same, while the wave path WP2 between the sub-reflection plate 122 and the first transceiver 136A may be changed to a wave path (not shown) between the sub-reflection plate 122 and the second transceiver 136B. In such state, communication of a wave of a second band different from the first band may be performed between the external source and the second transceiver 136B.

As described above, the main reflection plate 112 and the sub-reflection plate 122 may operate independently irrespective of a characteristic of a frequency band of a wave to be transmitted and received. For example, the communication system 1 may allow the main reflection plate 112 to rotate on the elevation axis, irrespective of whether the wave of the first band or the wave of the second band is to be transmitted and received.

Figure 10:
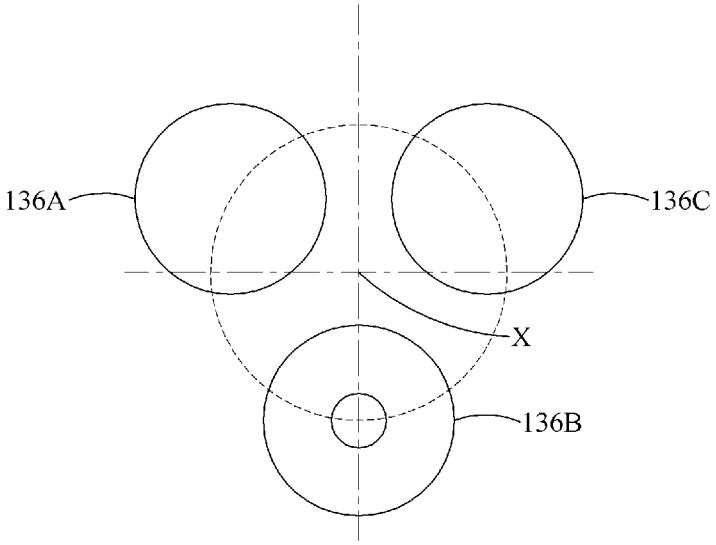
FIG. 10 is a conceptual diagram illustrating a band changer according to another example embodiment.

Referring to FIG. 10, a band changer according to another example embodiment includes three transceivers 136A, 136B, and 136C. The three transceivers 136A, 136B, and 136C are configured to respectively transmit and receive waves of different frequency bands. The transceivers 136A, 136B, and 136C are disposed separately from one another in a circumferential direction based on a rotation axis X. Here, intervals among the transceivers 136A, 136B, and 136C in the circumferential direction may be the same, but not limited thereto. The intervals may vary based on a size and a shape that may vary based on a characteristic of a wave to be transmitted and received by each of the transceivers 136A, 136B, and 136C.

Figure 11:
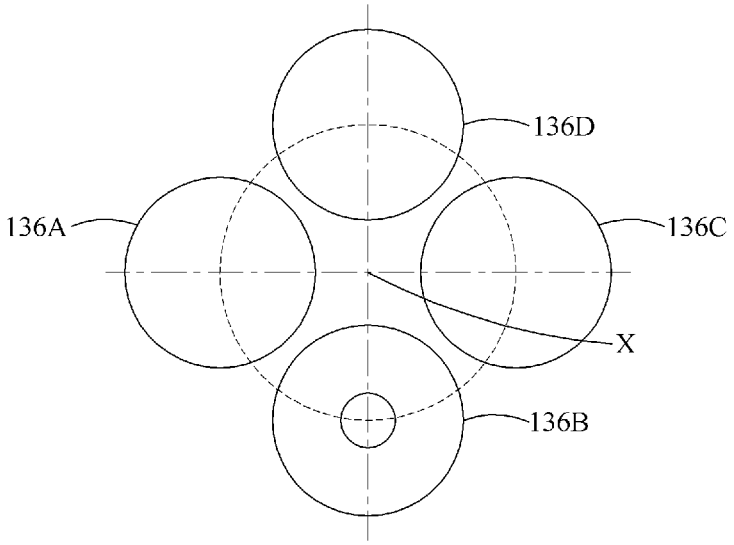
FIG. 11 is a conceptual diagram illustrating a band changer according to still another example embodiment.

Referring to FIG. 11, a band changer according to still another example embodiment includes four transceivers 136A, 136B, 136C, and 136D. The four transceivers 136A, 136B, 136C, and 136D are configured to respectively transmit and receive waves of different bands. The transceivers 136A, 136B, 136C, and 136D are disposed separately from one another in a circumferential direction based on a rotation axis X. Here, intervals among the transceivers 136A, 136B, 136C, and 136D in the circumferential direction may be the same, but not limited thereto. The intervals may vary based on a size and a shape that may vary based on a characteristic of a wave to be transmitted and received by each of the transceivers 136A, 136B, 136C, and 136D.

Figure 12:
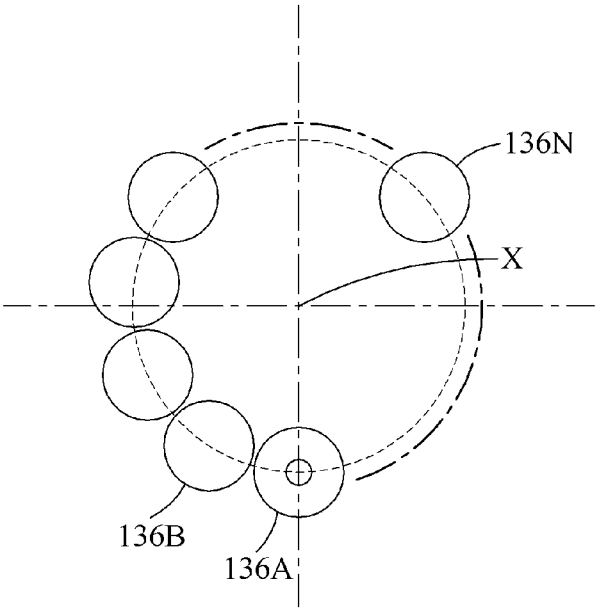
FIG. 12 is a conceptual diagram illustrating a band changer according to yet another example embodiment.

Referring to FIG. 12, a band changer according to yet another example embodiment includes a plurality of transceivers 136A, 136B, . . . , and 136N. The transceivers are configured to respectively transmit and receive waves of different bands. The number of the transceivers may be determined based on a size of a space in which they are to be provided. The transceivers are disposed separately from one another in a circumferential direction based on a rotation axis X. Here, intervals among the transceivers in the circumferential direction may be the same, but not limited thereto. The intervals may vary based on a size and a shape that may vary based on a characteristic of a wave to be transmitted and received by each of the transceivers.

Figure 13:
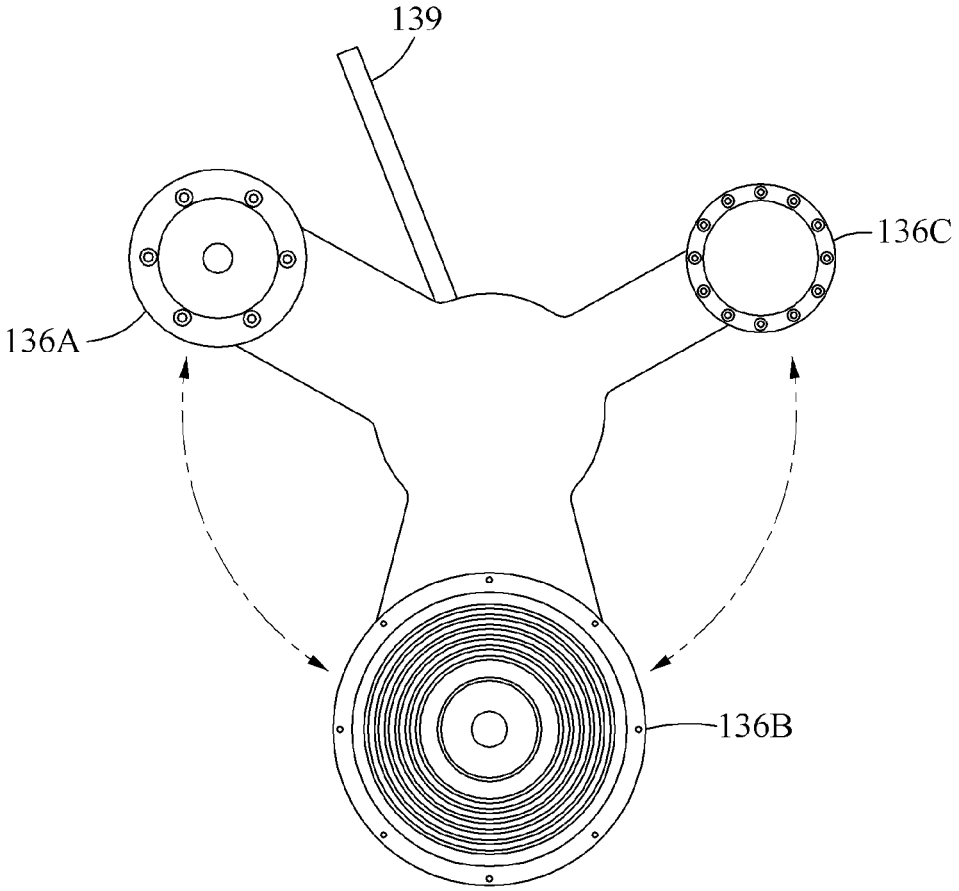
FIG. 13 is a conceptual diagram illustrating a structure configured to restrict a rotation of a rotor of a band changer according to an example embodiment.

Referring to FIG. 13, a band changer according to an example embodiment further includes a stopper 139 configured to mechanically restrict a rotation of a plurality of transceivers 136A, 136B, and 136C. For example, the stopper 139 may be provided in the rotor 134 (refer to FIG. 4) in which the transceivers 136A, 136B, and 136C are provided. The stopper 139 is configured to prevent unrestricted rotations in one rotational direction of the rotor 134. In addition, the stopper 139 is configured to provide a reference position of the rotor 134. For example, the reference position may be set to be a position at which the first transceiver 136A is restricted by the stopper 139 as rotating in a clockwise direction when the rotor 134 operates initially (refer to FIG. 13). Alternatively, the reference position may be set to be a position at which the third transceiver 136C is restricted by the stopper 139 as rotating in a counterclockwise direction when the rotor 134 operates initially (refer to FIG. 13). The stopper 139 is provided in a shape or form extending in a radius direction of the rotor 134.

Hereinafter, a control method of a communication system will be described in detail. For components to be described with reference to FIGS. 14 and 15, reference may be made to the foregoing description of the components provided above.

Figure 14:
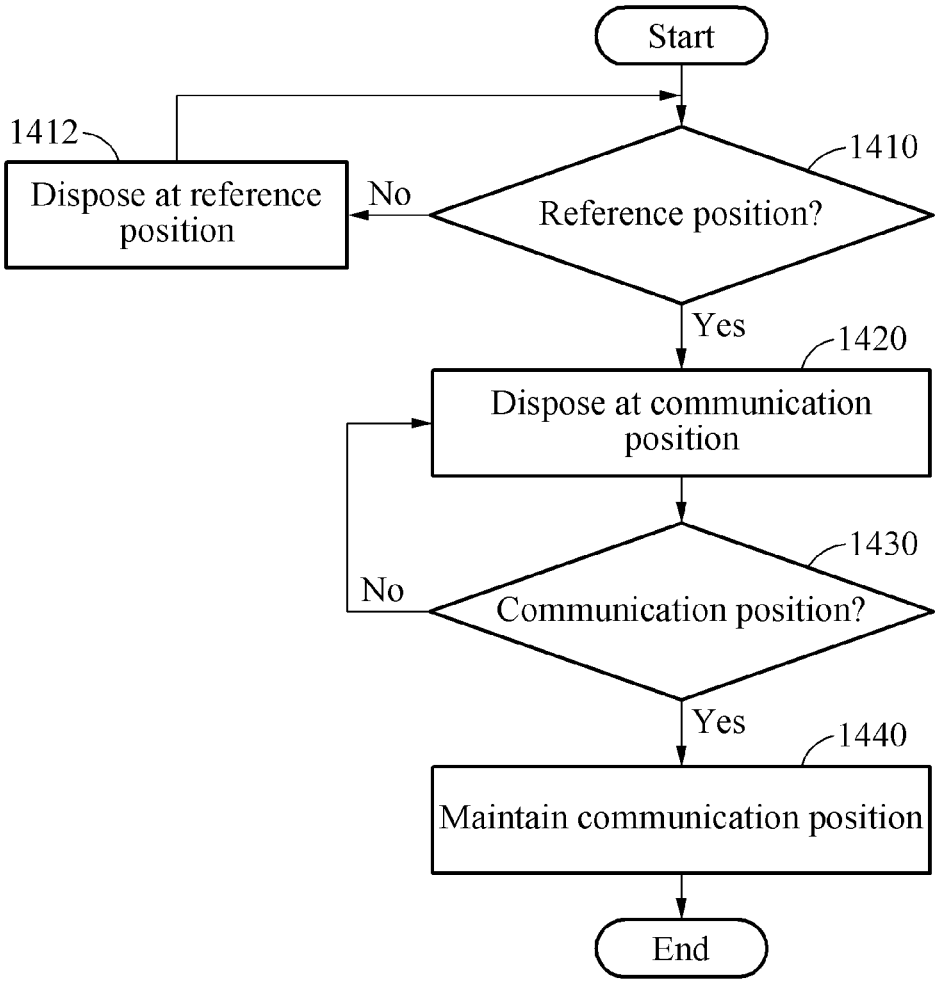
FIG. 14 is a flowchart illustrating an example of controlling a communication system according to an example embodiment.

Referring to FIG. 14, in operation 1410, a communication system according to an example embodiment checks whether a rotor is located at a reference position. The communication system may include, for example, a sensor 221 (depicted in FIG. 4) configured to sense a rotation angle of the rotor. A controller of the communication system may control a rotation of the rotor based on a rotation angle of the rotor that is sensed by the sensor 221.

When the rotor is not located at the reference position, the communication system operates the rotor to be at the reference position in operation 1412, and checks again whether the rotor is located at the reference position in operation 1410.

In operation 1420, when the rotor is located at the reference position, the communication system operates the rotor to be at a communication position. The communication position used herein may be associated with a position of a transceiver configured to transmit and receive a wave of a target band that the communication system desires to transmit and receive. That is, the communication position may be a position on a circumference of the rotor by which a wave path is to be defined. In operation 1430, the communication system checks whether the rotor is located at the communication position.

When the rotor is not located at the communication position, the communication system operates again the rotor to be at the communication position in operation 1420.

In operation 1440, when the rotor is located at the communication position, the communication system maintains the rotor being at the communication position.

Although not illustrated, as a set time elapses while the rotor stays at the communication position in operation 1440, the communication system operates the rotor in operation 1420 such that a transceiver having another target band to transmit and receive a wave of the other target band is to be located at the communication position.

Figure 15:
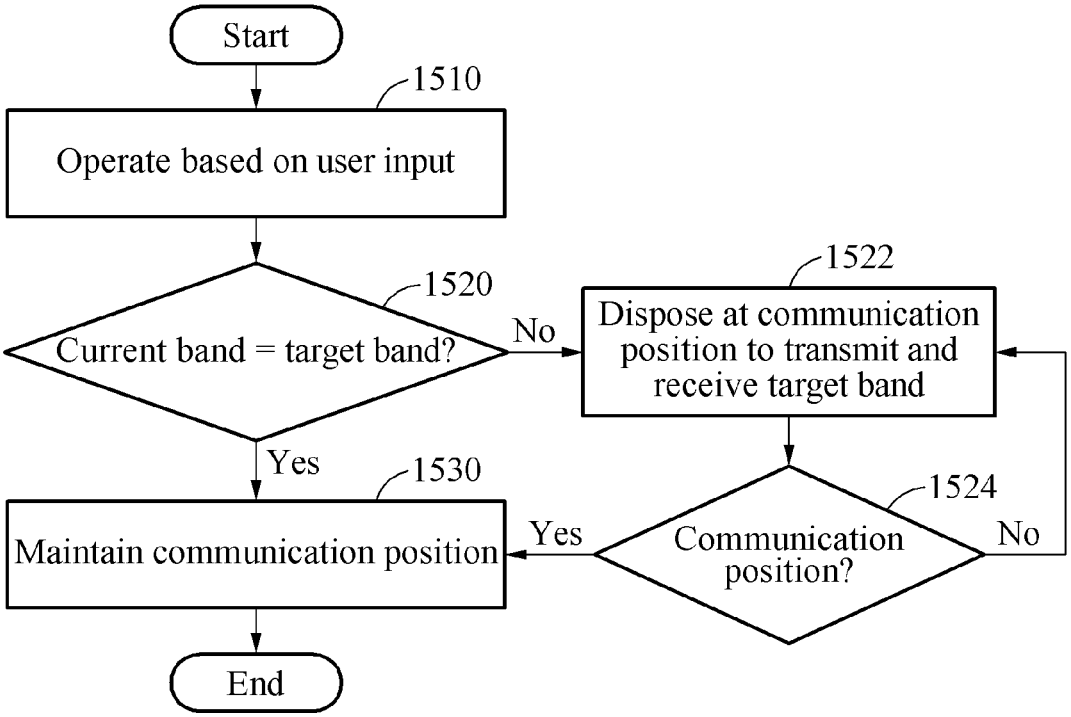
FIG. 15 is a flowchart illustrating another example of controlling a communication system according to an example embodiment.

Referring to FIG. 15, a communication system according to an example embodiment controls an operation of a rotor based on an input of a user. In operation 1510, the communication system operates the rotor such that a transceiver having a target band is to be at a communication position based on an input of a user on a desired target band of the user. In operation 1520, the communication system checks whether a currently transmitting and receiving band corresponds to the target band at a current angle of the rotor.

In operation 1530, when the current band corresponds to the target band, the communication system maintains the transceiver that transmits and receives the target band to stay at the communication position. That is, the communication system maintains the current angle of the rotor.

In operation 1522, when the current band does not correspond to the target band, the communication system operates the rotor such that the transceiver having the target band is to be located at the communication position. In operation 1524, the communication system checks whether the transceiver having the target band is located at the communication position. When the transceiver is located at the communication position, the communication system maintains the transceiver to stay at the communication position in operation 1530. When the transceiver is not located at the communication position, the communication system operates the rotor such that the transceiver having the target band is to be located at the communication position in operation 1522.

The methods according to the above-described example embodiments may be recorded in non-transitory computer-readable media including program instructions to implement various operations of the above-described example embodiments. The media may also include, alone or in combination with the program instructions, data files, data structures, and the like. The program instructions recorded on the media may be those specially designed and constructed for the purposes of example embodiments, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher level code that may be executed by the computer using an interpreter. The above-described devices may be configured to act as one or more software modules in order to perform the operations of the above-described example embodiments, or vice versa.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents.

What is claimed is:

1. A band changer comprising:

a reflector having a center area and an edge area positioned radially outward of the center area;

an aperture positioned at the edge area of the reflector;

a rotor positioned within the aperture of the reflector and having a rotation axis;

an actuator positioned on the reflector radially inward of the rotor and configured to rotate the rotor; and a plurality of transceivers disposed separately from the rotation axis and provided in the rotor along a circumferential direction of the rotor, the plurality of transceivers being configured to transmit and receive waves respectively having different frequency bands.

2. The band changer of claim 1, wherein the rotor is configured to rotate on the rotation axis such that a transceiver of the plurality of transceivers configured to transmit and receive a wave of a target band is located at a communication position by which a wave path is defined.

3. The band changer of claim 1, wherein the rotor is configured to rotate both in a first direction and a second direction which is opposite to the first direction.

4. The band changer of claim 1, wherein the rotor is configured to rotate only in a first direction.

5. The band changer of claim 1, wherein a distance between the rotation axis and a first axis of a first transceiver among the plurality of transceivers is equal to a distance between the rotation axis and a second axis of a second transceiver among the plurality of transceivers.

6. The band changer of claim 5, wherein the rotation axis, the first axis, and the second axis are parallel to one another.

7. The band changer of claim 1, wherein the plurality of transceivers are connected directly to one another.

8. A communication system comprising:

a main reflector having a center area;

a sub-reflector positioned radially outward of the center area of the main reflector; and a band changer including:

a rotor having a rotation axis; and an actuator positioned on the main reflector radially inward of the rotor and configured to rotate the rotor;

a plurality of transceivers disposed separately from the rotation axis, the plurality of transceivers provided in the rotor along a circumferential direction of the rotor and configured to transmit and receive waves respectively having different frequency bands, wherein the rotor is configured to rotate on the rotation axis such that a wave path leading to the main reflector, the sub-reflector, and one transceiver of the plurality of transceivers is formed.

9. The communication system of claim 8, wherein the rotor is rotatably provided in the main reflector.

10. The communication system of claim 9, wherein the rotor is provided in an edge area of the main reflector.

11. The communication system of claim 10, wherein the sub-reflector includes:

a sub-reflection plate disposed to face the edge area of the main reflector; and a supporting arm fixed to the main reflector and extending from the main reflector, and the supporting arm configured to support the sub-reflection plate.

12. The communication system of claim 8, wherein the band changer further comprises:

a stator provided in the main reflector and configured to support a rotation of the rotor.

13. The communication system of claim 8, wherein the plurality of transceivers are disposed to pass through front and rear sides of the rotor along the rotation axis of the rotor.

14. A communication system comprising:

a reflector having a center area and an edge area positioned radially outward of the center area;

an aperture positioned at the edge area of the reflector;

a band changer including a rotor having a rotation axis positioned within the aperture, and a plurality of transceivers disposed separately from the rotation axis, the plurality of transceivers provided in the rotor along a circumferential direction of the rotor and configured to transmit and receive waves respectively having different frequency bands;

a controller configured to generate a control signal that determines a rotation angle of the rotor such that a transceiver of the plurality of transceivers configured to transmit and receive a wave of a target band is located at a communication position by which a wave path is defined on a circumference of the rotor; and a driver positioned on the main reflector radially inward of the rotor relative to the center area and configured to operate the rotor to allow the rotor to rotate based on the control signal.

15. The communication system of claim 14, wherein the controller is configured to:

generate a first control signal in response to selection of a first frequency band to rotate, by a first angle, a first transceiver of the plurality of transceivers configured to transmit and receive a wave of the first frequency band; and generate a second control signal in response to selection of a second frequency band different from the first frequency band to rotate, by a second angle different from the first angle, a second transceiver of the plurality of transceivers configured to transmit and receive a wave of the second frequency band different from the first frequency band.

16. The communication system of claim 14, further comprising:

a sensor configured to sense a rotation angle of the rotor with respect to the rotation axis.

17. The communication system of claim 14, wherein the band changer further comprises:

a stopper configured to define a reference position that restricts a rotation of the rotor.

18. The communication system of claim 14, wherein the controller is configured to:

generate a reference control signal to control a rotation of the rotor such that the first transceiver of the plurality of transceivers is located at a reference position restricting the rotation of the rotor.

19. The communication system of claim 18, wherein the controller is configured to:

check whether the first transceiver of the plurality of transceivers is located at the reference position when the rotor operates.

20. The communication system of claim 14, wherein the controller is configured to:

check whether a frequency band of a wave transmitted and received by the transceiver of the plurality of transceivers located at the communication position after the rotor rotates by the determined rotation angle corresponds to the target band.

21. A method of controlling a band changer arranged within an aperture of a reflector, comprising a plurality of transceivers configured to transmit and receive waves respectively having different frequency bands, the method comprising:

receiving an input on selection of a frequency band;

generating a control signal based on the received input; and disposing, based on the control signal, a transceiver of the plurality of transceivers positioned within a rotor via an actuator positioned radially inward of the rotor relative to a center area of the reflector, the transceiver of the plurality of transceivers configured to transmit and receive a wave of the selected frequency band to be at a communication position by which a wave path is defined, wherein the rotor is rotatably positioned within the aperture of a reflector.

22. The method of claim 21, wherein the disposing comprises:

moving, by a first distance, a first transceiver of the plurality of transceivers configured to transmit and receive a wave of a first frequency band in response to selection of the first frequency band to define a first wave path, and disposing the first transceiver of the plurality of transceivers at the communication position.

23. The method of claim 22, wherein the disposing further comprises:

moving, by a second distance different from the first distance, a second transceiver of the plurality of transceivers configured to transmit and receive a wave of a second frequency band in response to selection of the second frequency band different from the first frequency band to define a second wave path, and disposing the second transceiver of the plurality of transceivers at the communication position.

24. A non-transitory computer-readable storage medium storing instructions that, when executed by a processor, cause the processor to perform the method of claim 21.

* * * * *